US005950832A

United States Patent [19]

Perlman

[11] Patent Number: 5,950,832

[45] Date of Patent: Sep. 14, 1999

[54] ELASTOMERIC SHEET AND SUPPORT MEMBER FOR STORING SPECIMEN VIALS

[75] Inventor: Daniel Perlman, Arlington, Mass.

[73] Assignee: Brandeis University, Waltham, Mass.

[21] Appl. No.: 09/090,093

[22] Filed: Jun. 3, 1998

[51] Int. Cl.[6] ..... B65D 85/20; A47B 23/00

[52] U.S. Cl. ..... 206/446; 206/562; 211/74; 422/104

[58] Field of Search ..... 206/443, 446, 206/558, 562, 563, 564; 211/70.6, 74; 422/61, 64, 102, 104

[56] References Cited

U.S. PATENT DOCUMENTS

| | | | |
|---|---|---|---|
| 3,446,342 | 5/1969 | Michel | 206/459.5 X |
| 3,643,812 | 2/1972 | Mander et al. | 206/558 X |
| 4,898,278 | 2/1990 | Leoncavallo et al. | 206/443 |
| 5,080,232 | 1/1992 | Leoncavallo et al. | 206/446 |
| 5,133,939 | 7/1992 | Mahe | 422/104 |
| 5,242,053 | 9/1993 | Rowe | 206/446 |

*Primary Examiner*—Bryon P. Gehman
*Attorney, Agent, or Firm*—Lyon & Lyon LLP

[57] ABSTRACT

A specimen vial storage assembly is described which includes multiple specimen vials, a rigid support member, and a flexible sheet storage device. The rigid support member is substantially uniform in height when placed upon a horizontal surface, and includes at least one upwardly facing first opening whose outer perimeter is defined by at least one perimeter support wall of substantially uniform height. The flexible sheet storage device includes a flexible elastomeric sheet material penetrated by an array of sized second openings which can frictionally bind and secure the specimen vials. The storage sheet device is removably placed upon, and supported by the upper surface of the perimeter support wall of the rigid support member, so that when a specimen vial is pushed downward through one of the second openings and into the first opening, a portion of the specimen vial is frictionally held by the storage sheet device.

26 Claims, 2 Drawing Sheets

ELASTOMERIC SHEET AND SUPPORT MEMBER FOR STORING SPECIMEN VIALS

BACKGROUND OF THE INVENTION

This invention relates to a means of storing and incubating microcentrifuge tubes and other specimen vials using an elastomeric sheet storage device in conjunction with a rigid support member.

Plastic microcentrifuge tubes, cryogenic storage tubes, and other small sealable vials (collectively termed specimen vials) which have hinged and/or screw-type caps, and hold between approximately 0.1 milliliters and 2 milliliters of liquid are well known in the fields of biology, biochemistry immunology, and biotechnology. These specimen vials are routinely stored and manipulated in multi-place (e.g., multi-hole) storage racks which are commercially available in many shapes and sizes (see, for example, Fisher Scientific Catalog 1998–1999, pages 1405–1409). Typical microcentrifuge tube racks have a capacity for between 10 and 100 tubes, and usually hold them upright and somewhat loosely for easy removal from the rack. It is not uncommon for such vials to tumble out of a rack if the rack is accidentally bumped and overturned while being stored in a refrigerator or freezer. Some racks are fabricated with snap-on covers or hinging lids to provide a measure of security against loss or mix-up of sample vials if the rack is accidentally dropped or overturned. Many racks for vials fall into two structural types (see above Fisher Catalog). One type consists of an injection-molded solid or hollow plastic block, e.g., molded polyethylene, polypropylene, polycarbonate, or acrylic, containing a rectilinear array of cylindrical holes to support cylindrical and conically bottomed specimen vials. Also described is a rack made of polyester foam which has resilient sockets. Another type of rack is reminiscent of a traditional rectangular test tube rack, and contains square openings.

SUMMARY OF THE INVENTION

The majority of specimen vials, such as those used in many biology, biochemistry, and medical laboratories, are stored in uncovered racks in which accidental loss and mix-up of samples is possible because the vials are only loosely held, and therefore susceptible to falling out of the round or square storage holes, i.e., openings, for the vials in the racks. On the other hand, covered racks which tend to be more expensive and are larger than uncovered racks are often viewed as occupying too much valuable space in a refrigerator or freezer. As a result, laboratory personnel are usually left with using the racks which provide no means to prevent specimen vials from falling out.

Thus, this invention pertains to means of storing and incubating specimen vials using a specimen vial storage assembly including two parts. This assembly includes a flexible or elastomeric sheet storage device having a two-dimensional array of holes (used to hold and secure the vials by friction fit), and a rigid support member such as a conventional vial storage rack (for supporting the elastomeric sheet as the vials are pushed downward through its holes). In preferred embodiments, the assembly also includes multiple specimen vials, which may be inserted in the elastomeric sheet storage device. The invention also concerns the elastomeric sheet storage device and methods for using the device and storage assembly.

A specimen vial storage rack, such as a microcentrifuge tube rack, can be generally described as a three-dimensional rectilinear framework with openings for holding specimen vials or, alternatively, a solid or hollow block-like structure with well-like openings in which the vials are generally loosely held. In the present invention, however, an elastomeric sheet material, preferably a waterproof material, is used as an accessory to, or as a replacement for the specimen vial storage rack. A sheet material, such as 2–6 pound per cubic foot density closed-cell polyethylene, polypropylene, or a copolymer foam material between approximately 1/16 and 1 inch thick, is selected which can be readily perforated with round or square holes (e.g., by die-cutting), and which retains long term elastic memory following linear compression and/or extension of up to at least 25%. For example, after a 3/8 inch diameter round opening has been die-cut through the sheet material, and the sheet has been locally stretched by insertion of a 15/32 inch diameter specimen vial to form an opening which is approximately 125% of its original diameter, the material continues to exert elastic pressure on a vial after at least one week of storage at room temperature and in a freezer at −20 degrees Celsius.

The size of the openings (also known as holes or perforations) is chosen to be slightly smaller than the size, i.e., diameter, of the vials being held in the openings (e.g., approximately 0.005–0.100 inch smaller in diameter for a 1/4–1/2 inch diameter vial) so that the vials are securely held by friction-fit in the openings. The thickness of the sheet is selected to suit the physical demands of the particular laboratory application for the storage sheet, and the particular vials being held in the sheet. For example, freezer storage of 0.5 inch tall vials may require only a 1/8 inch thick polyethylene foam sheet for effective retention, whereas for support of vials floating in an incubation water bath a 3/8 inch thick sheet may be preferable.

In one useful configuration of the present invention, the elastomeric sheet storage device for vials is configured and arranged such that the locations of the geometric centers of an array of die-cut holes in the sheet can be co-aligned with existing openings in a conventional rigid storage rack for specimen vials. That is, the array of holes in the storage sheet match the location of existing holes in a rigid storage rack for specimen vials so that when the sheet is placed on top of the rack for physical support, a vial can be pushed downward through a storage sheet hole and into the corresponding rack opening. While the array of openings in the rack generally hold the specimen vials loosely, the elastomeric storage sheet holes hold specimen vials securely by friction force. The term "securely" indicates that specimen vials will not fall from the storage sheet when it is inverted or gently shaken.

In practicing the present invention, the elastomeric sheet described above (typically fabricated from a plastic elastomeric cellular foam or rubber material, and containing its array of perforated openings for holding vials) is placed, in "piggy-back" fashion, on top of a conventional storage rack, with the rack's openings for vials facing upward. The rack, with its wider openings aligned with the smaller openings in the flexible storage sheet, cooperates with the flexible sheet, allowing specimen vials to be pushed through, and frictionally secured in the flexible sheet. In the process of specimen vial insertion, a portion of each vial extends downwardly through the storage sheet, and at least part way into the holes of the rack. To appreciate the economy and security of vial storage in the presently described elastomeric sheets, the analogy can be made to the current well known plastic webbing with six holes used to hold together the familiar "six pack" of American beer.

Once a set of specimen vials has been thusly inserted into the storage sheet, the sheet and vials can be removed from the rack and stored in a more compact form than would be possible in any of the conventional and bulkier rigid storage racks which enclose at least the bottoms of the vials. Security against accidental loss of specimen vials is also achieved because the vials are held tightly in the storage sheet. As an additional benefit, since the bottoms of specimen vials protrude beneath the storage sheet, and the storage sheet readily floats in water, the vials and the samples residing in the bottoms of these vials, may be conveniently incubated by floating the storage sheet and vials in a thermostated water bath. This floating incubation method is advantageous because, regardless of water evaporation, samples floating in an ample water depth will experience a constant incubation environment. By contrast, when vials rest in a conventional rack on the floor of an incubation bath, the water depth around the specimen vial can change dramatically as water evaporates, necessitating vigilant monitoring and replenishing of the water level to avoid changing the incubation conditions for samples.

The present invention allows a single conventional storage rack to be used as a temporary support device for assembling, i.e., inserting, many hundreds or even thousands of specimen vials into a multiplicity of flexible storage sheets described herein. In fact, the support device for the storage sheets can be as simple as an open, four-sided rectangular support frame (in the shape of a window frame) having dimensions somewhat smaller than the outer dimensions of a storage sheet so that it can support the sheet when a vial is pushed through an opening in the sheet. Use of the storage sheets described herein for long term sample storage is beneficial because the flexible storage sheet device is fabricated from less material, and is less expensive to manufacture than the typical conventional storage rack. Thus, use of these sheets can liberate conventional storage racks currently encumbered and out of circulation in many laboratories, due to their present use in long term storage of specimen vials, e.g., long term freezer storage.

Conventional storage racks are much more useful for short term experiments involving multiple specimen vials and repeated manipulation of the individual vials, and the samples therein. In some instances, however, the laboratory worker may decide to use the flexible storage sheet device as a semi-permanent frictional locking device for securing samples in a conventional rigid storage rack. In this case, the storage sheet can remain mounted upon the upper surface of the rack, and racks, thus modified, can be stacked and stored in a freezer, for example. For protecting and storing specimen vials with maximum economy, corrugated cardboard, and other low cost materials are also being used to fabricate specimen vial storage racks. In this regard, the presently described elastomeric storage sheet device may be integrated into the construction of these low cost racks, or used as a frictional locking feature with these racks after their construction.

The term "assembly" as used herein, refers to the physical combination of a flexible sheet storage device (e.g., as described above), resting on a rigid support member which provides physical support for the flexible sheet storage device, at least during the insertion of specimen vials into the sheet. As indicated above, the "assembly" may also include other components, particularly specimen vials frictionally held in the flexible sheet storage device.

The term "rigid support member" has been described above, and is further described below. It includes support frames which can be as simple as a rigid rectangular frame consisting of a low rigid support wall of essentially uniform height, typically 1 to 2 inches tall (defined as a "perimeter support wall" which essentially encloses an open space (referred to as an "upwardly facing first opening"). When this upwardly facing opening is bridged, and its outer perimeter covered by the flexible sheet storage device, there is underlying open space which allows specimen vials to be inserted, pushed downward, and secured in the flexible sheet storage device. If a conventional specimen vial storage rack is used as the "rigid support member" rather than a simple rectangular frame, then the rack includes a multiplicity of upwardly facing openings rather than a single opening. The perimeter support wall is preferably, but not necessarily a continuous wall both vertically and horizontally. However, the perimeter support wall may also be differently configured so long as it is able to support a flexible sheet storage device for insertion of specimen vials. For example, the perimeter support wall may be a perimeter wire or narrow surface held in place by posts or an open wire structure. The portion of the perimeter support wall forming the upper perimeter may even be discontinuous around the perimeter.

Consistent with the above definitions, in a convention specimen vial storage rack, generally each upwardly facing opening (which accommodates a single specimen vial) is surrounded by a "perimeter support wall" which defines each opening. Together, the multiplicity of perimeter support walls around the openings for the specimen vials define the upper surface of the specimen vial storage rack. In either case, the rigid support member (support frame or specimen vial rack) functions to support and elevate the storage sheet at a substantially uniform height above the laboratory bench so that vials can be easily pushed downward through the openings in the storage sheet.

The term "flexible elastomeric sheet material" is a qualitative term, meant to describe a bendable, stretchable (and sometimes, but not always, compressible), and compliant material (exemplified by numerous examples throughout the text), which can frictionally bind specimen vials. Such a material is used to fabricate the "flexible sheet storage device" which secures the specimen vials. A "flexible sheet storage device" is thus a device constructed as a sheet of flexible elastomeric material which has an array of openings or perforations sized to frictionally retain specimen vials of appropriate size inserted in those openings.

The term "frictionally" (bind, hold, or secure) refers to the ability of a flexible elastomeric sheet material to provide sufficient frictional resistance (force) against sliding, so that a smooth-walled glass or plastic specimen vial inserted into a die-cut opening (whose diameter is 10% smaller than the diameter of the vial), will not fall out of the hole when the flexible sheet holding the vial is at least gently shaken.

Thus, in a first aspect, the invention provides a specimen vial storage assembly which includes a flexible sheet storage device (also simply referred to as the "storage device"), and a rigid support member. Preferably the assembly also includes multiple specimen vials. The rigid support member is substantially uniform in height when placed upon a horizontal surface, and includes at least one upwardly facing first opening whose outer perimeter is defined by at least one perimeter support wall of substantially uniform height. The flexible sheet storage device includes a flexible elastomeric sheet material penetrated by an array of sized second openings which can frictionally bind and secure the specimen vials. The storage device is placed upon (i.e., removably mounted upon) and physically supported by the upper surface of the perimeter support wall of the rigid support member, so that when a specimen vial is pushed downward through one of the second openings in the storage device, and into the first opening in the support member, a portion of the specimen vial becomes frictionally held by the storage device.

In preferred embodiments, the storage device holding the specimen vials is removed from, i.e., lifted up and separated from, the rigid support member used to facilitate inserting the specimen vials. In another preferred embodiment, the height of the perimeter support wall plus the thickness of the storage device is less than the height of the specimen vials so that when the specimen vials are pushed downward to the bottom of the first opening, a portion of the specimen vials remains protruding above the storage device.

In preferred embodiments, the rigid support member is selected from the group consisting of specimen vial storage racks and walled support frames.

Also in preferred embodiments, the at least one upwardly facing opening includes a first array of sized first openings which loosely hold the specimen vials without frictional binding, and the flexible sheet storage device includes a flexible elastomeric sheet material penetrated by a second array of sized second openings which can frictionally bind and secure the specimen vials. The storage device is removably mounted upon, and physically supported by the rigid storage rack. The centers of the second openings in the second array can be aligned with the centers of the first openings in the first array, so that when a specimen vial is pushed downward through one of the second openings and into one of the first openings, a portion of the specimen vial is frictionally held by the storage device. In further preferred embodiments, the storage device carrying frictionally secured specimen vials is removed from, i.e., is lifted away and separated from, the rigid storage rack. This separation allows incubation and storage of the vials in the space-saving storage sheet device without the rigid rack being present.

In preferred embodiments, the assembly which includes either a rigid support member, or a rigid storage rack for specimen vials, includes specimen vials which are selected from the group consisting of microcentrifuge tubes, polymerase chain reaction tubes, cryogenic sample storage vials, cuvettes, and test tubes. The storage device includes square or round openings which are arranged in an array preferably selected from the group consisting of rectilinear, offset rectilinear, circular and spiral arrays to hold said specimen vials. The flexible elastomeric sheet material for the storage device is preferably selected from the group consisting of rubber sheet, foamed rubber sheet, foamed thermoplastic sheet, rubber net sheet, and thermoplastic net sheet material. Within this group, the foamed rubber and foamed thermoplastic sheet materials are preferably selected from the group consisting of closed and open-cell foam materials. Additionally, within this group, the foamed thermoplastic sheet material is preferably selected from the group consisting of foamed polyolefin and foamed polyolefin copolymer thermoplastic sheet material. The foamed polyolefin thermoplastic sheet material is preferably selected from the group consisting of foamed polypropylene, foamed polyethylene, and copolymer materials thereof. The flexible elastomeric sheet material preferably has a thickness ranging between approximately 0.05 inches and 1 inch, more preferably between 0.125 inches and 1 inch, still more preferably between 0.125 and 0.75 inches, and most preferably between 0.125 and 0.5 inches.

In a related aspect, the assembly which includes either a rigid support member, or a rigid storage rack for specimen vials and a plurality of copies of the storage device with frictionally secured specimen vials, in which the storage devices can be separated from the rigid support member or storage rack, and stacked one upon the other to save space during specimen vial storage. Thus, in yet another related aspect, the invention provides a plurality of flexible storage devices with frictionally secured specimen vials stacked one upon another.

In another aspect, this invention features a method for frictionally securing multiple specimen vials in a storage device, to prevent accidental displacement or loss of the vials. The method includes the steps of: (i) providing a specimen vial storage assembly which includes a rigid support member and a flexible sheet storage device for specimen vials, in which the rigid support member is substantially uniform in height when placed upon a horizontal surface, and includes at least one upwardly facing first opening whose outer perimeter is defined by at least one perimeter support wall of substantially uniform height. The storage device includes a flexible elastomeric sheet material penetrated by an array of sized second openings which can frictionally bind and secure the specimen vials, (ii) placing, i.e., removably mounting, the storage device upon the upper surface of the perimeter support wall of the rigid support member for physical support, (iii) pushing at least a portion of the specimen vials downward through the second openings and into the first opening, thereby frictionally securing the specimen vials in the storage device.

In preferred embodiments, the method further includes the step of lifting and removing the storage device including frictionally secured specimen vials from said rigid support member.

In preferred embodiments, this method further includes the step of storing, e.g., freezing away, the storage device including its frictionally secured specimen vials. This method also includes the step of incubating the storage device including its frictionally secured specimen vials. Such incubation can, for example, be by flotation of the storage device and vials in a thermostat-controlled water bath.

In preferred embodiments, the rigid storage rack includes a first array of sized first openings which loosely hold the specimen vials without frictional binding. The storage device includes a flexible elastomeric sheet material penetrated by a second array of sized second openings which can frictionally bind and secure the specimen vials. The method includes placing, i.e., removably mounting, the storage device upon the upper surface of the rigid storage rack for physical support, such that the sized second openings are aligned with the sized first openings, and pushing at least a portion of a specimen vial downward through one of the second openings and into one of the first openings, thereby frictionally securing a portion of the specimen vial in the storage device.

In further preferred embodiments, this method further includes the step of lifting and removing the storage device, including its frictionally secured specimen vials, away from the rigid storage rack.

In another aspect, the invention provides a flexible sheet storage device which has an array of openings or perforations matching the array of openings in a conventional, commercially available storage rack or support frame. Preferably the storage rack or support frame has 80 or 96 openings, preferably matching the openings in a Fisher Scientific storage rack, e.g., current Fisher Scientific catalog numbers 05-541 (80 hole) and 05-541-29 (96 hole); current VWR Scientific Products Corp catalog no.30128-266, or current USA Scientific Plastics catalog no. 2380-1000. In preferred embodiments, the openings are arranged in a rectilinear array in which the centers of openings have center to center spacings selected from the group consisting of approximately 0.5 by 0.5 inches, 0.5 by 0.65 inches, 0.65 by 0.65 inches, and 0.75 by 0.75 inches. Also in preferred embodiments, the openings have a diameter of ⅜ inch or ¼ inch. In connection with the center to center spacing of openings, the term "approximately" indicates that the actual dimension is within 10% of the specified dimension, preferably within 5%.

Additional features and advantages of the present invention will be apparent from the following description of the preferred embodiments and from the claims.

DESCRIPTION OF THE PREFERRED EMBODIMENTS

GENERAL DESCRIPTION

Figure 1:
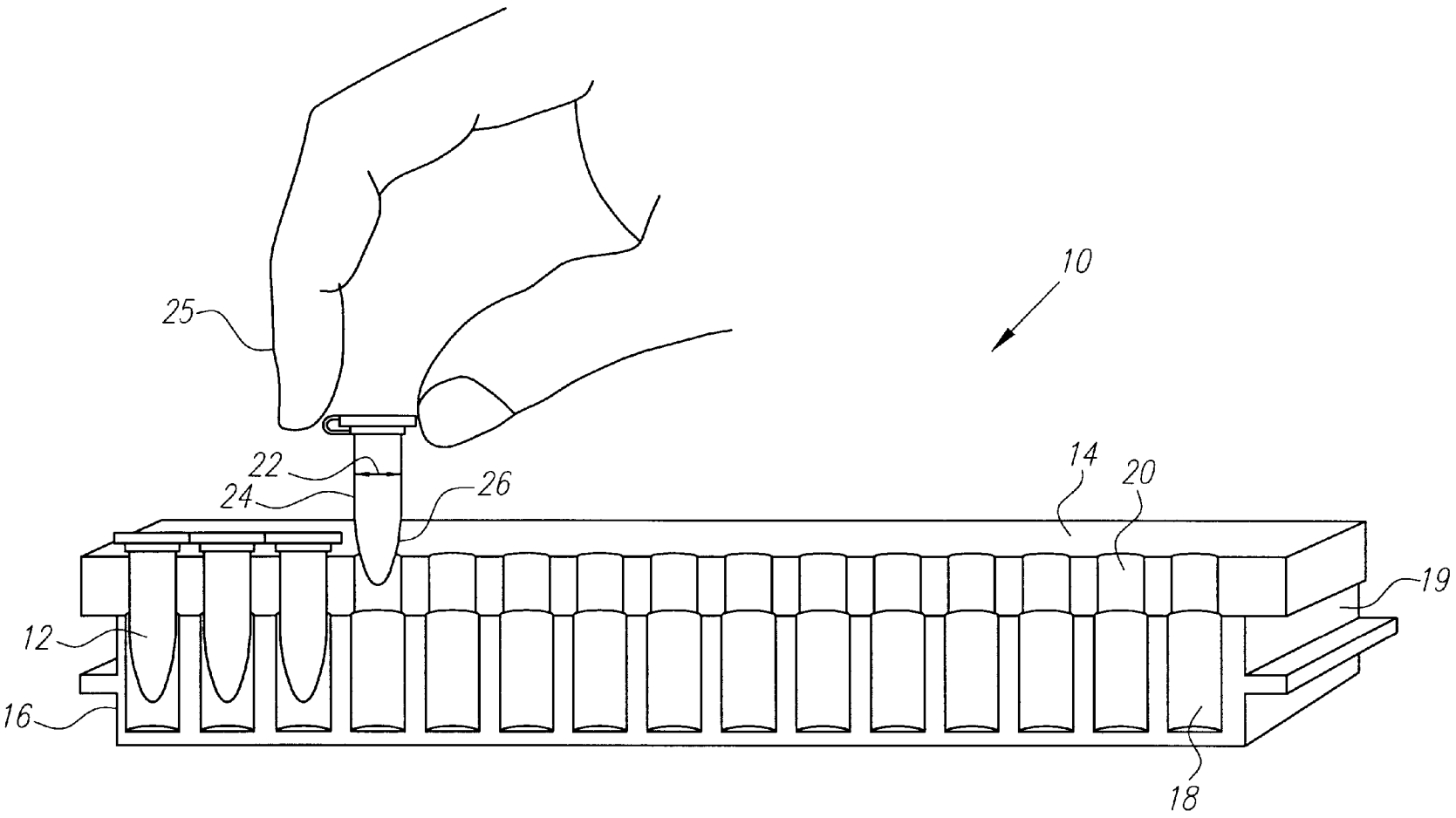
FIG. 1 is a perspective side view in partial section showing specimen vials inserted downward through the flexible sheet storage device and into an underlying rigid support rack.

This section describes the structure and use of a specimen vial storage assembly suitable for assembling specimen vials in an elastomeric sheet device for incubating and storing specimens in specimen vials such as microcentrifuge tubes. The elastomeric storage device complements the traditional rigid plastic storage rack which holds vials loosely (inverting such a rack typically results in the vials falling from the rack). That is, in the elastomeric sheet device, specimen vials are frictionally secured, preventing them from being lost even when the sheet is inverted.

The elastomeric sheet is preferably die-cut from a resilient closed-cell foam material so that when a die-cut hole is temporarily stretched by inserting a specimen vial of a size which is slightly larger than the hole (e.g., 10%–20% larger in diameter), the hole diminishes again in size when the vial is removed. This elastic memory is important so that the sheet can be used multiple times to frictionally secure the same diameter of storage vial.

It is preferred that closed cell foams used in the present invention can hold vials over a wide range of temperatures. For example, it is often desirable to store materials in freezers ranging downward in temperature from −20 degrees to −80 degrees Celsius. At the upper temperature range it is sometimes desirable to briefly incubate samples in a boiling water bath at 100 degrees Celsius. A cross-linked closed-cell polyethylene foam, a copolymer polyethylene foam (e.g., low and high density polyethylene) or a polypropylene foam (such as the 2–4 pound per cubic foot density M series cross-linked polyethylene or L series polypropylene foams manufactured by Voltek Inc., Lawrence, Mass., or the 2–4 pound density SSP series of foams manufactured by Sentinel Products Corp., Hyannis, Mass.) is suitable for these uses.

A useful thickness for the foam sheet may range from approximately 0.05 to 1 inch depending upon the size of specimen vial, the linear dimensions of the storage sheet, and the end use of the storage sheet, e.g., whether the vials will be stored in a freezer, or floated in a boiling water bath. A thicker sheet may be particularly useful in providing more frictional "grab" and more buoyancy in a water bath, for example.

Closed cell foams are also particularly useful in the present invention because, compared to open cell foams, they absorb relatively little liquid, and are therefore easily cleanable if and when chemicals are spilled on their surface. It is also preferred that the material selected for fabricating the elastomeric sheet is one which resists a wide variety of solvents and caustic agents because specimen vials may contain such agents. Polyolefin foams and polyester foams are examples of such materials.

Once a suitable elastomeric sheet material is selected, the pattern and lay-out of perforations or die-cut openings for specimen vials can be selected to match the lay-out of openings in one or more of the currently popular specimen vial storage racks. This spatial matching is practical because it allows the elastomeric sheet to be removably mounted upon, and supported by a rigid support member, e.g., the rack, thereby facilitating the insertion of vials through the holes in the sheet (using downward pressure), and down into the corresponding holes in the rack. If such a rack is not available, a simple open rectangular frame can be used to elevate and support the sheet while vials are being inserted into the sheet's openings.

Figure 2:
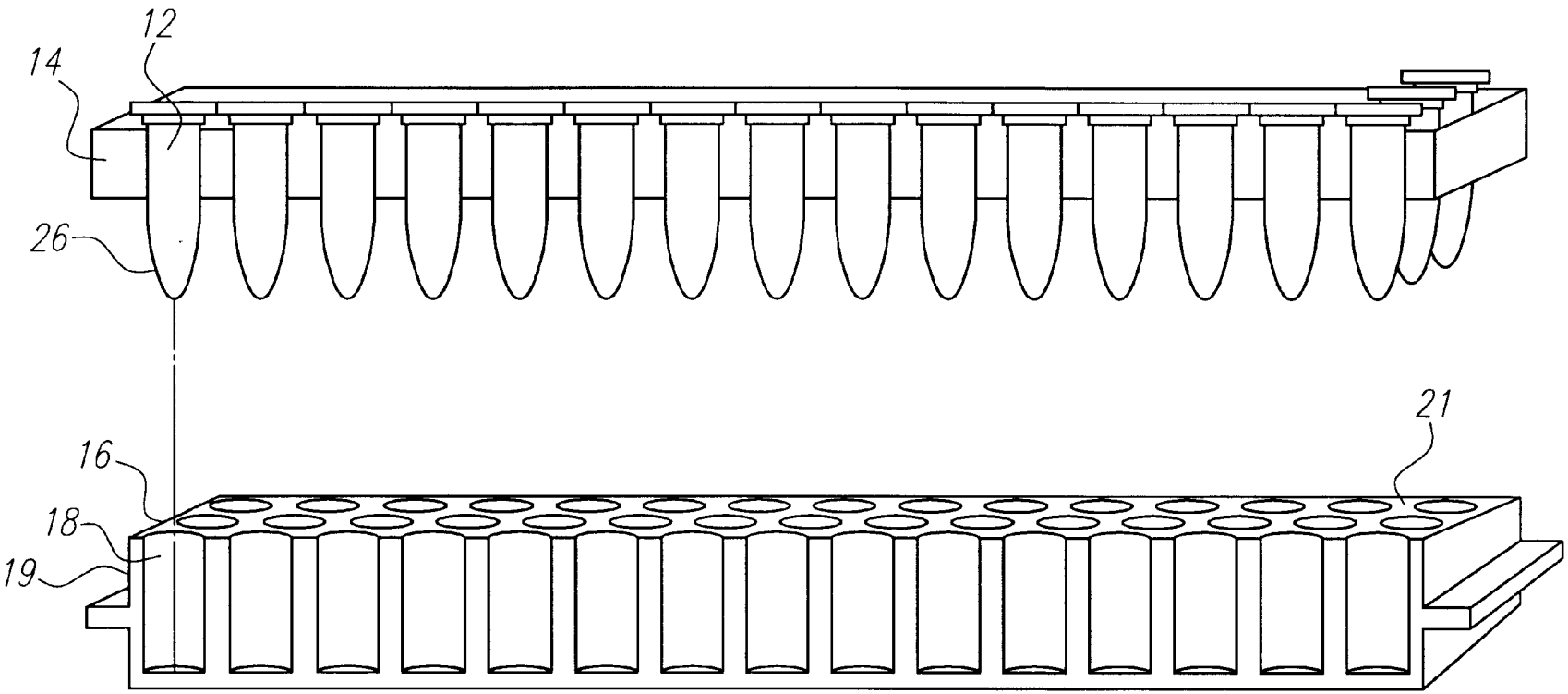
FIG. 2 is a perspective side view in partial section showing the flexible sheet storage device of FIG. 1 (with specimen vials), lifted free of the underlying rack.

The design and use of an exemplary specimen vial storage assembly of the present invention is shown in FIG. 1 and FIG. 2. Referring to FIG. 1, an exemplary specimen vial storage assembly (herein abbreviated "assembly") 10, including specimen vials (herein abbreviated "microtubes") 12 which, in this particular instance, are polypropylene thermoplastic microcentrifuge tubes capable of holding up to approximately 1.5–2.0 milliliters of liquid. Assembly 10 also includes a flexible sheet storage device (herein abbreviated "storage device") 14, and a rigid support member (herein abbreviated "storage rack") 16 which, in the present example, is a widely commercialized rigid polypropylene block-type microcentrifuge tube storage rack (available, e.g., from Fisher Scientific, Inc., Pittsburgh, Pa., catalog no. 05-541 or from VWR Scientific Products Corp., S. Plainfield, N.J., catalog no. 30128-266 or from USA Scientific Plastics, Ocala, FLa., catalog no. 2380-1000). Storage rack 16, measuring approximately 8.5 inches long×2.5 inches wide×1 inch thick) contains eighty openings 18 to hold microtubes 12. Each opening 18 (also referred to as a "first opening" in the above text) which is capable of loosely holding microtube 12, has a diameter of approximately 7/16 inch and a depth of 15/16 inch. The eighty openings 18 in storage rack 16 are arranged in an array of 16×5. Perimeter support wall 19 is substantially uniform in height, and its upper surface 21 supports the storage device 14 (see also FIG. 2).

The storage sheet device 14 is typically fabricated from an elastomeric closed cell foam material, e.g., polyethylene, polypropylene, or polyester, or alternatively, may be open cell foam, foam rubber, rubber sheet, or a flexible plastic webbing material which may contain net-like openings. In the example shown, storage device 14, covers a somewhat larger area, and overhangs storage rack 16. This extra area and overhang facilitates separating the two elements (14 and 16), if desired, after the storage device 14 has been loaded with microtubes 12.

The thickness of elastomeric material used in the storage device 14 depends upon the material selected and its end-use. For example, a suitable rubber sheet material may be only 1/16 inch thick, whereas a closed cell foam may be as much as 0.5 to 1.0 inch thick. Die-cut holes 20 (also referred to as a "second opening" in the above text) in the storage device 14 are sized to be slightly smaller than the outer diameter 22 of the upper portion 24 of microtubes 12. These holes 20 frictionally bind and secure microtubes 12 after the lower portion 26 of microtubes 12 are inserted, and the microtubes are then pushed downward with ones fingers 25 as depicted. In the case of the depicted microtubes 12, holes 20 measure approximately ⅜ inch in diameter (and the difference between the diameters of the somewhat larger openings 18 and somewhat smaller holes 20 is approximately 1/16 inch). The geometric centers of the array of holes 20 in storage device 14 are arranged so that they co-align with the centers of the array of openings 18 in storage rack 16. This co-alignment allows microtubes 12 to be easily inserted through holes 20, and downward into openings 18 in storage rack 16, and subsequently to be easily removed, together with the storage device 14, which unites and secures the ensemble of microtubes 12 (see FIG. 2).

Referring to FIG. 2, the specimen vial storage assembly depicted in FIG. 1 (item 10)) is shown after the storage device 14 with microtubes 12 secured therein, has been lifted free, and removed from storage rack 16 with its array of openings 18. This separation of elements 14 and 16 is not a requirement, but rather an option within the scope of the present invention, depending upon the objectives of the laboratory worker. If security against loss of specimens is the only requirement, then storage device 14 may be left in place on storage rack 16. If, on the other hand, the laboratory worker wishes to store, e.g., freeze away, specimens in microtubes 12, and also wishes to utilize the same storage rack 16 for another purpose, then separation of elements 14 and 16 is necessary. If the laboratory worker wishes to flash-freeze, or alternatively, incubate specimens in microtubes 12 using either a freezing bath (e.g., dry ice-ethanol) or a warm water bath, then separation of elements 14 and 16 is again very helpful so that the lower portion 26 of the microtubes 12 can be immersed in either bath. If a buoyant closed cell foam material is used in fabricating storage device 14, then it may be conveniently floated on either bath.

EXAMPLE

MICROTUBE PIGGY-BACKS™

"Lock-in" Foam Sheet Racks for Holding Tubes & Vials

The MICROTUBE PIGGY-BACKS™ described herein are exemplary flexible sheet storage devices. PIGGY-BACKS™ are foam sheets with die-cut openings that circle microtubes of appropriate size. The 80 hole (5×16 format), and 96 hole (8×12 format) foam sheet geometries are constructed to precisely match two of the most popular block-type microtube racks‡, hole for hole. Once microtubes are transferred to the PIGGY-BACKS™, the block-racks will be freed up for short-term experimental procedures. For quick insertion of microtubes, place a PIGGY-BACKS™ sheet on top of the matching block-rack (for physical support) and simply push the tubes down through the die-cut openings and into the rack. Then remove the PIGGY-BACKS™ sheet with its microtubes.

‡ Fisher Scientific cat.™05-541(80 hole) and cat.™05-541-29 (96 hole)

These devices are useful to secure microtubes for storage and for incubation. PIGGY-BACKS™ firmly and elastically secure 1.5 ml and 0.5 ml microtubes. The microtubes do not fall out, even with dropping, freezing, heating, floating in water, and shipping. Due to their compactness, the PIGGY-BACKS™ provide more efficiently use of microtube storage space in the freezer as compared to storage in common rigid storage racks.

These flexible sheet storage devices provide excellent chemical and physical stability. The devices are constructed from cross-linked polyolefin closed cell foam, which does not absorb liquids, and is resistant to most solvents, acids, and alkalis. While all closed-cell foams will bend temporarily when placed in a boiling water bath, PIGGY-BACKS™ will not be damaged by boiling water.

The devices are constructed to provide convenient identification of specimen vial contents. A permanent marker or ball-point pen can be used to write directly on the PIGGY-BACKS™ sheets to identify samples (a convenient writing border extends around the perimeter of the PIGGY-BACKS™).

The flexible sheet storage devices can be configured for a variety of different applications. For example the exemplary devices are constructed in 80 and 96 hole PIGGY-BACKS™ formats. Each of these formats are constructed with either ¼ inch or ⅜ inch diameter holes (for 0.5 ml capacity and 1.5–2.0 ml capacity microtubes, respectively). Further, each of these PIGGY-BACKS™ is, in turn, constructed in both an "easy grip" style (3/16 inch thick) or a "robust grip" style (⅜ inch thick) to provide a choice between a more flexible and thinner, and a thicker style. For example, the thicker sheet may be preferred for greater rigidity and buoyancy if the PIGGY-BACKS™ are being used as a floating rack for incubating microtubes in a water bath. The thinner sheet may be preferred for its lighter grip, and easier release of microtubes. In addition, the PIGGY-BACKS™ can be left on top of regular block racks to lock microtubes into place so they can't fall out.

All patents and publications mentioned in the specification are indicative of the levels of skill of those skilled in the art to which the invention pertains. All references cited in this disclosure are incorporated by reference to the same extent as if each reference had been incorporated by reference in its entirety individually.

One skilled in the art would readily appreciate that the present invention is well adapted to carry out the objects and obtain the ends and advantages mentioned, as well as those inherent therein. The materials and configurations and methods described herein as presently representative of the preferred embodiments are exemplary and are not intended as limitations on the scope of the invention. Changes therein and other uses will occur to those skilled in the art which are encompassed within the spirit of the invention are defined by the scope of the claims.

It will be readily apparent to one skilled in the art that varying substitutions and modifications may be made to the invention disclosed herein without departing from the scope and spirit of the invention. For example, those skilled in the art will recognize that the invention may be practiced using a variety of different materials for the storage device as will as a variety of different support or storage racks.

The invention illustratively described herein suitably may be practiced in the absence of any element or elements, limitation or limitations which is not specifically disclosed herein. Thus, for example, in each instance herein any of the terms "comprising", "consisting essentially of", and "consisting of" may be replaced with either of the other two terms. The terms and expressions which have been employed are used as terms of description and not limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups or other grouping of alternatives, those skilled in the art will recognize that the invention is also thereby described in terms of any individual member or subgroup of members of the Markush group or other group.

Thus, additional embodiments are within the scope of the invention and within the following claims.

I claim:

1. A specimen vial storage assembly comprising a rigid support member and a flexible sheet storage device, wherein said rigid support member is substantially uniform in height when placed upon a horizontal surface, and comprises at least one upwardly facing first opening whose outer perimeter is defined by at least one perimeter support wall of substantially uniform height, and said storage device comprises a flexible stretchable and compressible elastomeric foam sheet material 0.125 to 1 inch in thickness penetrated by an array of sized second openings which can frictionally bind and secure specimen vials, wherein said storage device is removably mounted upon, and physically supported by the upper surface of said perimeter support wall of said rigid support member, so that when a specimen vial is pushed downward through one of said second openings and into said first opening, a portion of the specimen vial is frictionally held by said storage device.

2. The specimen vial storage assembly of claim 1, further comprising multiple specimen vials.

3. The assembly of claim 2 wherein the height of said at least one perimeter support wall plus the thickness of said storage device is less than the height of said specimen vials.

4. The assembly of claim 2, wherein said specimen vials are selected from the group consisting of microcentrifuge tubes, polymerase chain reaction tubes, cryogenic sample storage vials, cuvettes, and test tubes.

5. The assembly of claim 1 wherein said rigid support member is selected from the group consisting of specimen vial storage racks and walled support frames.

6. The specimen vial storage assembly of claim 1, wherein said at least one upwardly facing first opening comprises a first array of sized first openings which loosely hold the specimen vials without frictional binding, and said storage device comprises a flexible, stretchable and compressible elastomeric sheet material penetrated by a second array of sized second openings which can frictionally bind and secure the specimen vials, wherein the centers of said second openings in said second array are aligned with the centers of said first openings in said first array, so that when a specimen vial is pushed downward through one of said second openings and into one of said first openings, a portion of the specimen vial is frictionally held by said storage device.

7. The assembly of claim 1, wherein said storage device comprises square or round second openings which are arranged in an array selected from the group consisting of rectilinear, offset rectilinear, circular and spiral arrays.

8. The assembly of claim 1, wherein said flexible elastomeric sheet material is selected from the group consisting of foamed rubber sheet and foamed thermoplastic sheet.

9. The assembly of claim 8, wherein said foamed rubber and foamed thermoplastic sheet materials are selected from the group consisting of closed and open-cell foam materials.

10. The assembly of claim 8, wherein said foamed thermoplastic sheet material is selected from the group consisting of foamed polyolefin and foamed polyolefin copolymer thermoplastic sheet material.

11. The assembly of claim 10, wherein said framed polyolefin thermoplastic sheet material is selected from the group consisting of foamed polypropylene, foamed polyethylene, and copolymer materials thereof.

12. The assembly of claim 1, wherein said flexible, stretchable and compressible elastomeric sheet material has a thickness from 0.125 to 0.75 inches.

13. The assembly of claim 1 wherein said flexible, stretchable and compressible elastomeric foam sheet material is 0.125 to 0.5 inches in thickness.

14. A method for frictionally securing multiple specimen vials in a storage device, to prevent accidental displacement or loss of the vials, comprising the steps of:

providing a specimen vial storage assembly comprising a rigid support member and a flexible sheet storage device for specimen vials, wherein said rigid support member is substantially uniform in height when placed upon a horizontal surface, and comprises at least one upwardly facing first opening whose outer perimeter is defined by at least one perimeter support wall of substantially uniform height, and said storage device comprises a flexible, stretchable and compressible elastomeric foam sheet material 0.125 to 1 inch thickness penetrated by an array of sized second openings which can frictionally bind and secure the specimen vials, placing said storage device upon the upper surface of said perimeter support wall of said rigid support member for physical support, pushing at least a portion of the specimen vials downward through said second openings and into said first opening, thereby frictionally securing the specimen vials in said storage device.

15. The method of claim 14, further comprising the step of lifting and removing said storage device comprising frictionally secured specimen vials from said rigid support member.

16. The method of claim 15, further comprising the step of storing said storage device comprising frictionally secured specimen vials.

17. The method of claim 15, further comprising the step of incubating said storage device comprising frictionally secured specimen vials.

18. The method of claim 17, wherein said storage device comprising frictionally secured specimen vials is incubated by flotation in a thermostat-controlled water bath.

19. The method of claim 14, wherein said at least one upwardly facing opening comprises a first array of sized first openings which loosely hold said specimen vials without frictional binding, and said storage device comprises a flexible elastomeric sheet material penetrated by a second array of sized second openings which can frictionally bind and secure said specimen vials, and wherein after placing said storage device upon the upper surface of said rigid storage rack for physical support, said sized second openings are aligned with said sized first openings.

20. The method of claim 19, further comprising the step of lifting and removing said storage device comprising frictionally secured specimen vials from said rigid storage rack.

21. The method of claim 14, wherein flexible, stretchable and compressible elastomeric foam sheet material is 0.125 to 0.5 inches in thickness.

22. A flexible sheet storage device comprising a flexible, stretchable and compressible elastomeric foam sheet 0.125 to 1 inch in thickness containing a plurality of openings sized and arranged to align with vial openings in a selected specimen vial storage rack or tube rack.

23. The device of claim 22, wherein said openings are arranged in a rectilinear array in which the centers of openings have center to center spacings selected from the group consisting of approximately 0.5 by 0.5 inches, 0.5 by 0.65 inches, 0.65 by 0.65 inches.

24. The device of claim 23, wherein a plurality of said openings are each ⅜ inches in diameter.

25. The device of claim 23, wherein a plurality of said openings are each ¼ inches in diameter.

26. The device of claim 22, wherein said flexible, stretchable and compressible elastomeric foam sheet material is 0.125 to 0.5 inches in thickness.

* * * * *